US006556109B2

(12) United States Patent
Kanba et al.

(10) Patent No.: US 6,556,109 B2
(45) Date of Patent: Apr. 29, 2003

(54) DUAL MODE BAND PASS FILTER

(75) Inventors: Seiji Kanba, Kusatsu (JP); Naoki Mizoguchi, Shiga-ken (JP); Hisatake Okamura, Nagaokakyo (JP); Harufumi Mandai, Takatsuki (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/855,298

(22) Filed: May 15, 2001

(65) Prior Publication Data

US 2002/0039059 A1 Apr. 4, 2002

(30) Foreign Application Priority Data

May 23, 2000 (JP) ..... 2000-151756

(51) Int. Cl.[7] ..... H01P 1/203
(52) U.S. Cl. ..... 333/204; 333/219
(58) Field of Search ..... 333/204, 205, 333/219, 995

(56) References Cited

U.S. PATENT DOCUMENTS

| | | | | |
|---|---|---|---|---|
| 4,488,131 A | | 12/1984 | Griffin et al. | |
| 5,136,268 A | * | 8/1992 | Fiedziuszko et al. | 333/204 |
| 5,750,473 A | * | 5/1998 | Shen | 333/204 |
| 6,041,245 A | * | 3/2000 | Mansour | 333/204 |

FOREIGN PATENT DOCUMENTS

| | | |
|---|---|---|
| EP | 0 814 532 A2 | 12/1997 |
| JP | 06-112701 | 4/1994 |
| JP | 09-139612 | 5/1997 |
| JP | 09-162610 | 6/1997 |
| WO | WO-95/28746 | * 10/1995 |

OTHER PUBLICATIONS

Awai et al., "Equivalent–Circuit Representation and Explanation of Attenuation Poles of a Dual–Mode Dielectric Resonator Bandpass Filter", IEEE trans. on Microwave theory & Techn., vol. 46, No. 12, Dec. 1998, pp. 2159–2163.*

J.A. Curtis and S.J. Fiedziuszko; Miniature Dual Mode Microstrip Filters, Apr. 1991 IEEE MTT–S Digest; pp. 443–446.

* cited by examiner

*Primary Examiner*—Seungsook Ham
(74) *Attorney, Agent, or Firm*—Keating & Bennett, LLP

(57) ABSTRACT

A dual mode band pass filter is constructed to be very compact and such that the coupling strength and bandwidth can be easily and widely adjusted while maintaining sufficient freedom of design. A metal film for forming a resonator is arranged on a first main surface of a dielectric body or at a certain height in the dielectric body. At least one ground electrode is arranged such that the ground electrode is opposed to the metal film via the dielectric body. The metal film is connected to input/output coupling circuits. In the region where the metal film is opposed to the ground electrode, two portions are partially provided. Each of these two portions has a relative permittivity that is different from the relative permittivity of the remaining portion, in order to couple two resonance modes.

19 Claims, 12 Drawing Sheets

DUAL MODE BAND PASS FILTER

BACKGROUND OF THE INVENTION

1. Field of the Invention

The present invention relates to dual mode band pass filters preferably used as, for example, band filters incorporated in communication apparatuses for high frequency bands ranging from a microwave band to a millimeter-wave band.

2. Description of the Related Art

Conventional filters include dual mode band pass filters used as band pass filters in high frequency bands (See, for example, "Miniature Dual Mode Microstrip Filters", J. A. Curtis and S. J. Fiedziuszko, 1991 IEEE MTT-S Digest, etc.)

FIGS. 13 and 14 show schematic plan views for illustrating conventional dual mode band pass filters.

In a band pass filter 200 shown in FIG. 13, a circular conductive film 201 is disposed on a dielectric body (not shown). The conductive film 201 is coupled to input/output coupling circuits 202 and 203 arranged to define an angle of 90 degrees. A top-end open stub 204 is arranged to form a central angle of 45 degrees with the position where the input/output coupling circuit 203 is arranged. With this arrangement, two resonance modes having different resonance frequencies are mutually coupled. As a result, the band pass filter 200 functions as a dual mode band pass filter. In addition, in a dual mode band pass filter 210 shown in FIG. 14, a square conductive film 211 is disposed on a dielectric body. The conductive film 211 is coupled to input/output coupling circuits 212 and 213 defining an angle of about 90 degrees. A corner defining an angle of about 135 degrees with the input/output coupling circuit 213 is cut away. By disposing a cut-away portion 211*a*, two resonance modes have different resonance frequencies. With this arrangement, since the two resonance modes are mutually coupled, the band pass filter 210 functions as a dual mode band pass filter.

On the other hand, as an alternative to a circular conductive film, a ring-shaped conductive film is used in dual mode band pass filters (Japanese Unexamined Patent Application Publication No. 9-139612, Japanese Unexamined Patent Application Publication No. 9-162610, etc.). In this case, with the use of a ring-shaped transmission line, as in the case of the dual mode band pass filter shown in FIG. 13, input/output coupling circuits are arranged at a central angle of 90 degrees, and a top-end open stub is disposed in a portion of the ring-shaped transmission line.

Furthermore, Japanese Unexamined Patent Application Publication No. 6-112701 provides a dual mode band pass filter using a similar ring-shaped transmission line. As shown in FIG. 15, a dual mode filter 221 includes a ring-shaped resonator defined by disposing a ring-shaped conductive film 222 on a dielectric body. In this case, each of the four terminals 223 to 226 is arranged to define an angle of 90 degrees with the ring-shaped conductive film 222. Of the four terminals, the two terminals 223 and 224 defining an angle of 90 degrees are coupled to input/output coupling circuits 227 and 228. The remaining two terminals 225 and 226 are connected to each other via a feedback circuit 230.

With this arrangement, in the ring-shaped resonator defined by one stripline, there are generated vertical resonance modes that are not coupled to each other. As a result, it is possible to control the coupling strength via the feedback circuit 230.

In each of the conventional dual mode band pass filters shown in FIGS. 13 and 14, with the use of one conductive film pattern, a two-stage band pass filter can be provided. As a result, miniaturization of the band pass filter can be achieved.

However, in such a circular or square conductive film pattern, since the input/output coupling circuits are coupled at the predetermined angle, the coupling strength cannot be increased. Thus, there is a problem in that a wider pass band cannot be obtained.

In the band pass filter shown in FIG. 13, the conductive film 201 has a circular shape. In the band pass filter shown in FIG. 14, the conductive film 211 has a square shape. Thus, the shapes of the conductive films are restricted. As a result, there is little freedom of design.

Furthermore, similarly, it is difficult to increase the coupling strength and there are restrictions on the shapes of the ring-shaped resonators in the dual mode band pass filters using the ring-shaped resonators in Japanese Unexamined Patent Application Publication No. 9-139612 and Japanese Unexamined Patent Application Publication No. 9-162610, as mentioned above.

On the other hand, in the dual mode band pass filter 221 described in Japanese Unexamined Patent Application Publication No. 6-112701, coupling strength is adjusted by using the feedback circuit 230 so that a wider bandwidth is obtained. However, since this dual mode filter needs the feedback circuit 230, the circuit structure is complicated. In addition, still, the shape of the resonator is restricted to a ring shape, thereby reducing the freedom of design.

SUMMARY OF THE INVENTION

In order to overcome the problems described above, preferred embodiments of the present invention provide a dual mode band pass filter that achieves miniaturization, facilitates adjustments of the coupling strength, achieves a wider pass band and greatly improves the freedom of design.

According to a first preferred embodiment of the present invention, there is provided a dual mode band pass filter including a dielectric body having a first main surface and a second main surface, a metal film partially disposed on the first main surface or at a certain height position in the dielectric body, at least one ground electrode disposed on the second main surface or inside the dielectric body in such a manner that the metal film is opposed to the ground electrode via a portion of the dielectric body, and a pair of input/output coupling circuits coupled to different parts of the metal film. In this dual mode band pass filter, in the region where the metal film is opposed to the ground electrode via the portion of the dielectric body, some portions of the dielectric body have relative permittivities that are different from a relative permittivity of the remaining portion so that two resonance modes generated at the metal film are mutually coupled.

In the dual mode band pass filter according to the first preferred embodiment of the present invention, the two resonance modes are generated in a direction that is substantially parallel to a virtual line connecting the portions coupling the pair of input/output coupling circuits to the metal film and in a direction that is substantially to the virtual line. In addition, in order to couple the two resonance modes, relative permittivities of the portions of the dielectric body in the region where the metal film is opposed to the ground electrode via the dielectric body are made different from the relative permittivity of the remaining portion. In other words, one of the two resonance modes is influenced by the dielectric-body portions having the different relative permittivities, and the resonance frequency of the influenced resonance mode thereby changes. As a result, the two resonance modes are mutually coupled. That is, since the portions of the dielectric body have different relative permittivities from that of the remaining portion, the band pass filter functions as a dual mode band pass filter.

In addition, the portions of the dielectric body having the different relative permittivities may be cavities formed in the dielectric body.

According to a second preferred of the present invention, a dual mode band pass filter includes a dielectric body having a first main surface and a second main surface, a metal film partially disposed on the first main surface or at a certain height position of the dielectric body, at least one ground electrode disposed on the second main surface or inside the dielectric body in such a manner that the metal film is opposed to the ground electrode via a portion of the dielectric body, and a pair of input/output coupling circuits coupled to different portions of the metal film. In this dual mode band pass filter, openings or cut-away portions are provided in the ground electrode in the region where the metal film is opposed to the ground electrode so that two resonance modes generated at the metal film are mutually coupled.

In this dual mode band pass filter, in order to couple the two resonance modes, in the region where the metal film is opposed to the ground electrode, the openings or the cut-away portions are provided in the ground electrode. As a result, two resonance modes are generated so as to propagate in a direction substantially parallel to a visual line connecting the portions for coupling the pair of input/output coupling circuits to the metal film and in a direction that is substantially perpendicular to the virtual line. One of the two resonance modes is influenced by the openings or the cut-away portions, with the result that the resonance frequency of the mode changes. In other words, the openings or the cut-away portions are arranged such that the openings or the cut-away portions influence the resonance electric fields or resonance currents of one of the resonance modes so as to mutually couple the two resonance modes. As a result, since the two resonance modes are mutually coupled by the openings or the cut-away portions, the band pass filter functions as a dual mode band pass filter.

Furthermore, the metal film may be disposed on the first main surface of the dielectric body and the ground electrode may be disposed on the second main surface thereof.

In addition, the shape of the metal film may have lengthwise directions and widthwise directions.

In addition, the planar shape of the metal film may be any of substantially rectangular, substantially rhombic, regular polygonal, substantially circular, or substantially elliptical.

Other features, elements, characteristics and advantages of the present invention will become more apparent from the following detailed description of the preferred embodiments of the present invention.

DETAILED DESCRIPTION OF PREFERRED EMBODIMENTS

The present invention will be clarified by the detailed illustration of preferred embodiments of the present invention.

Figure 1:
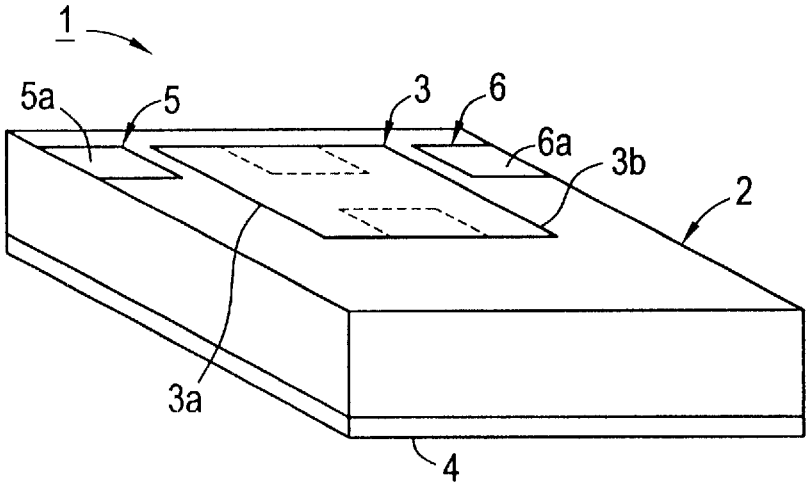
FIG. 1 shows a perspective view of a dual mode band pass filter according to a first preferred embodiment of the present invention.
Figure 2:
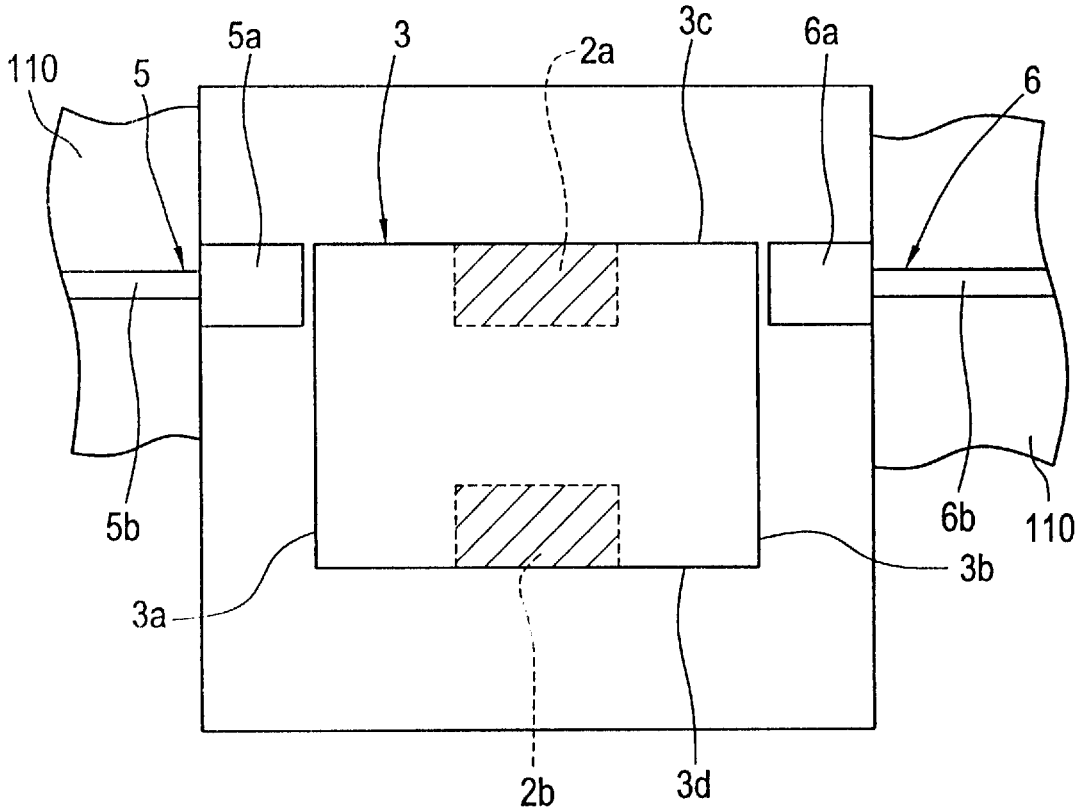
FIG. 2 shows a schematic plan view for illustrating the main section of the dual mode band pass filter according to the first preferred embodiment of the present invention.

FIG. 1 shows a perspective view for illustrating a dual mode band pass filter according to a first preferred embodiment of the invention. FIG. 2 shows a plan view for schematically illustrating the main portion of the dual mode band pass filter.

A dual mode band pass filter 1 includes a dielectric body 2 having a substantially rectangular planar configuration. On a top surface of the dielectric body 2 there is disposed a metal film 3 preferably made of Cu to define a resonator. The metal film 3 is partially provided on the dielectric body 3. The metal film 3 preferably has a substantially rectangular shape, in this preferred embodiment. That is, the shape of the metal film 3 includes widthwise and lengthwise directions.

In one example of this preferred embodiment, the metal film 3 is about 1.6 mm wide and about 1.4 mm long.

The dimensions of the metal film 3 are not restricted to those described above. According to desired central frequencies and bandwidths, the dimensions can be changed appropriately.

On the top surface of the dielectric body 2, lengthwise sides 3*a* and 3*b* of the metal film 3 are coupled to input/output coupling circuits 5 and 6 via predetermined gaps. The input/output coupling circuits 5 and 6 include input/output capacitance generating patterns 5*a* and 6*a* as portions coupled to the metal film 3 via capacitances. The input/output capacitance generating patterns 5*a* and 6*a* are connected to microstrip lines 5*b* and 6*b* as external lines disposed on a dielectric mother body 110 via side surface electrodes disposed on side surfaces of the dielectric body 2 and via-hole electrodes disposed inside the dielectric body 2. The side surface electrodes and the via-hole electrodes are not shown in the figure.

Locations of couplings between the input/output coupling circuits 5 and 6 and the metal film 3 are not restricted to those shown in the figure. However, they locations of such couplings are different from each other. In addition, although it is preferable that couplings between the metal film 3 and the input/output coupling circuits 5 and 6 are made via the capacitances, alternatively, strip lines or microstrip lines as the input/output coupling circuits may be directly connected to the metal film 3.

A ground electrode 4 is provided on an almost entire bottom surface of the dielectric body 2.

In the band pass filter 1 of the first preferred embodiment, the dielectric body 2 is not uniform, since there are some portions having relative permittivities different from that of the remaining portions of the dielectric body 2. In other words, in a region in which the metal film 3 is opposed to the ground electrode 4 via the dielectric body 2, there are formed portions 2*a* and 2*b* having relatively high permittivities. In this preferred embodiment, each of the portions 2*a* and 2*b* has a relative permittivity $\in r$ of about 17 and the remaining portion of the dielectric body 2 has a relative permittivity $\in r$ of about 7. The portions 2*a* and 2*b* having the relatively high permittivities are disposed along widthwise sides 3*c* and 3*d* of the substantially rectangular metal film 3 near the center of each of the widthwise sides 3*c* and 3*d*. In addition, each of the portions 2*a* and 2*b* has a substantially rectangular planer shape, and is extended from the top surface of the dielectric body 2 to the bottom surface thereof in the thickness directions of the dielectric body 2.

However, there are other various ways to form the dielectric body 2 including the portions 2*a* and 2*b* having permittivities higher than that of the remaining portion thereof. For example, after preparing a dielectric body 2, through-holes are made in areas for forming portions 2*a* and 2*b* and each of the through-holes is filled with a dielectric material having a relatively high permittivity. Alternatively, after preparing a substantially rectangular dielectric body, in a portion that is equivalent to each of portions 2*a* and 2*b* having relatively high permittivities there may be applied an element that reacts with a composite material of the dielectric body to cause heat diffusion so as to form the portions 2*a* and 2*b*.

In this preferred embodiment, the dielectric body 2 is preferably made of an oxide such as Mg, Si, or Al. In addition to the oxide, another oxide such as Ca or Ti is added to the portions 2*a* and 2*b* having relatively high permittivities.

In addition, each of the portions 2*a* and 2*b* having relatively high permittivities preferably has a substantially rectangular planer shape, which is, for example, approximately 200 $\mu$m long and approximately 600 $\mu$m wide.

In the dual mode band pass filter 1 of the present preferred embodiment, an input voltage is applied between one of the input/output coupling circuits 5 and 6 and the ground electrode 4 to extract an output voltage between the ground electrode 4 and the remaining one of the input/output coupling circuits 5 and 6. In this case, since the metal film 3 is substantially rectangular and there are provided the portions 2*a* and 2*b* have relatively high permittivities, two resonance modes are coupled to each other to allow the filter to function as a dual mode band pass filter. This is because the portions 2*a* and 2*b* have relatively high permittivities are arranged such that the two resonance modes generated at the metal film 3 are mutually coupled. This will be illustrated below with reference to FIGS. 3 to 7.

Figure 3:
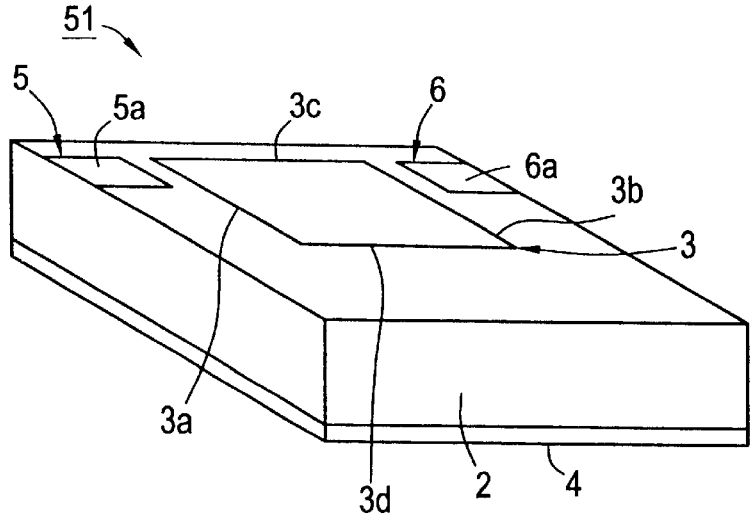
FIG. 3 shows a perspective view of a filter prepared for comparison to preferred embodiments of the present invention.
Figure 4:
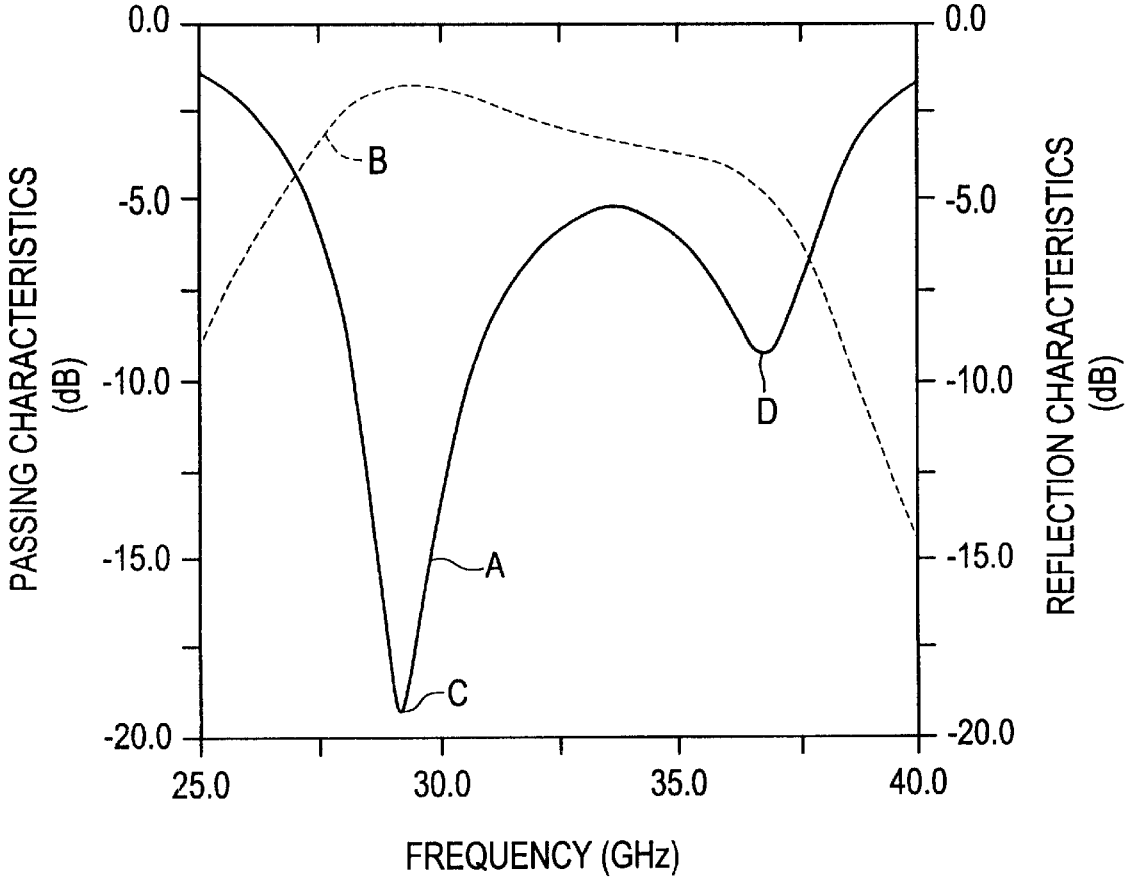
FIG. 4 shows a graph showing the frequency characteristics of the filter shown in FIG. 3.

FIG. 3 shows a perspective view of a filter 51 prepared for comparison to preferred embodiments of the present invention. The filter 51 has an arrangement that is the same as that of the dual mode band pass filter 1 of the present preferred embodiment, except that there are no portions 2*a* and 2*b* having relatively high permittivities. FIG. 4 shows the frequency characteristics of the filter 51.

In FIG. 4, a solid line A and a broken line B indicate the reflection characteristics and passing characteristics of the filter 51.

As shown in FIG. 4, although there are two resonance points as indicated by arrows C and D, the frequency positions of the resonance points are spaced apart from each other, by which resonance modes are not mutually coupled. In the filter 51, there are generated a resonance mode in a direction that is substantially parallel to a direction connecting points at which input/output coupling circuits 5 and 6 are coupled to a metal film 3, that is, along a widthwise direction of the metal film 3, and a resonance mode in a direction that is substantially perpendicular to the widthwise direction, that is, a lengthwise direction of the metal film 3. In FIG. 4, a resonance mode indicated by the arrow C, which is hereinafter referred to as a resonance mode C, is the resonance mode along the widthwise direction. A resonance mode indicated by the arrow D, which is hereinafter referred to as a resonance mode D, is the resonance mode along the lengthwise direction.

As shown in FIG. 4, since the two resonance points are in the mutually distant frequency positions, the resonance modes are not coupled to each other. In other words, the filter 51 does not function as a dual mode band pass filter.

Figure 5:
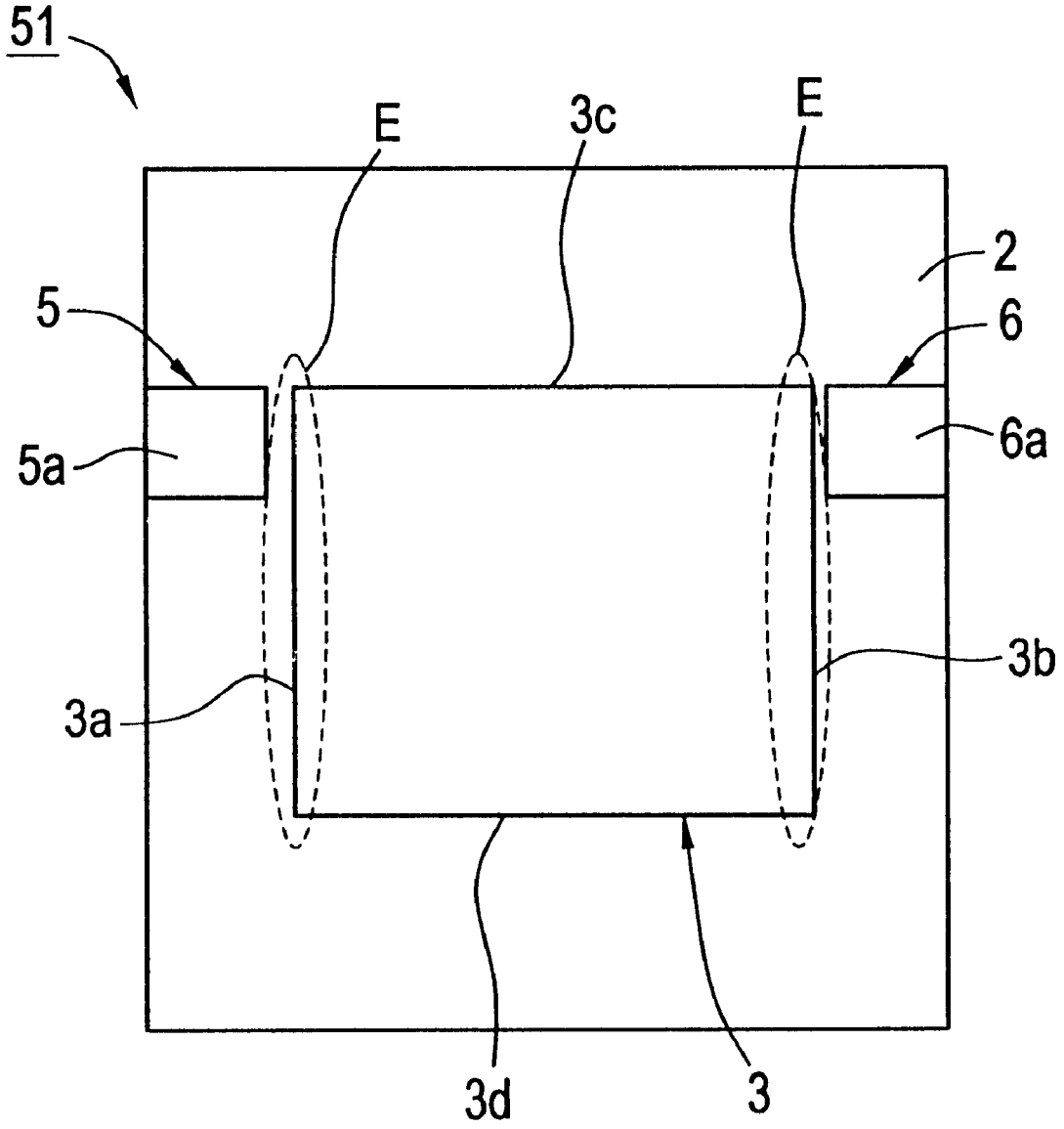
FIG. 5 shows a schematic plan view for illustrating portions at which resonance electric fields are intensively generated when resonances occur along the widthwise directions of the metal film in the filter shown in FIG. 3.
Figure 6:
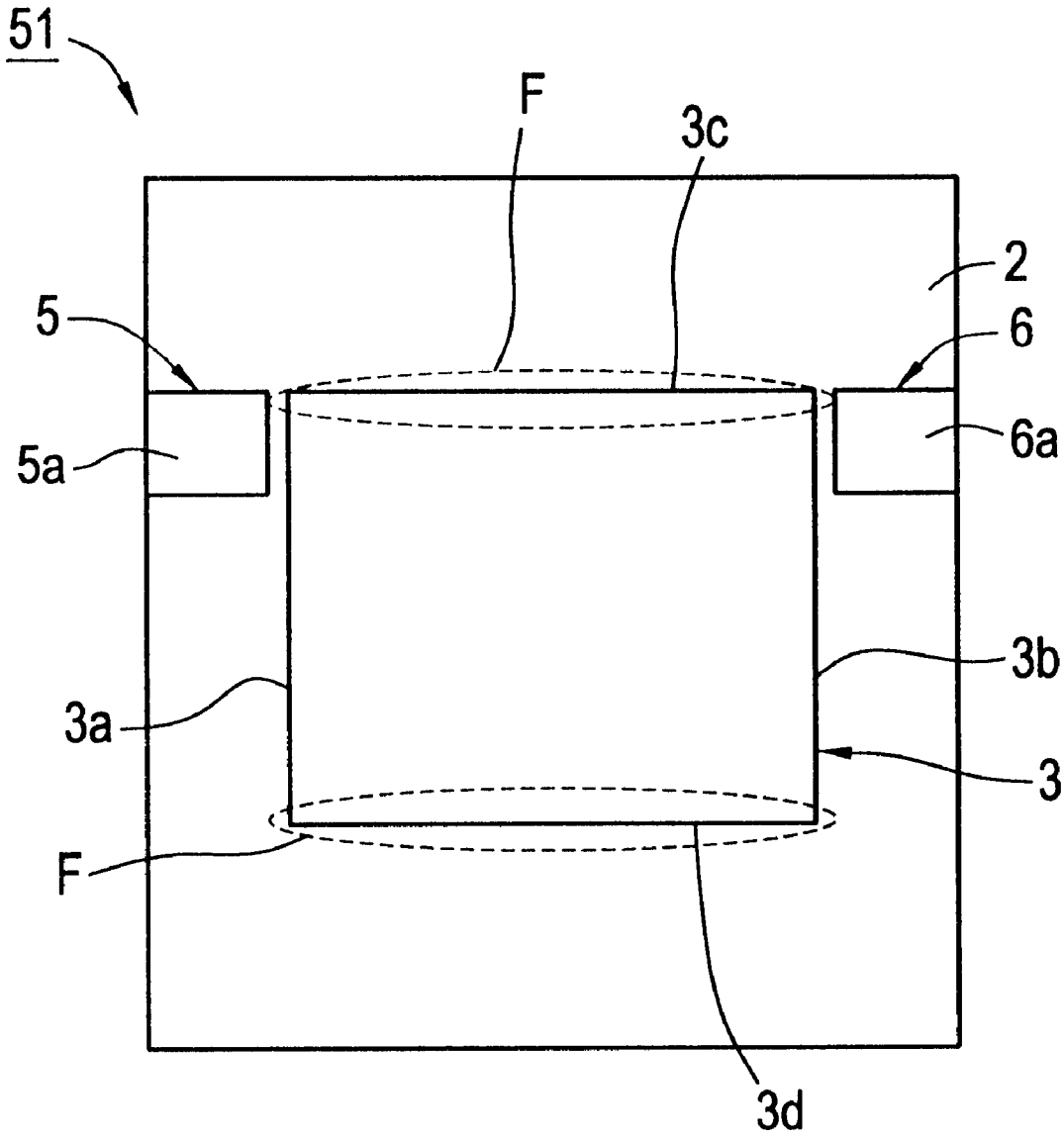
FIG. 6 shows a schematic plan view for illustrating portions at which resonance electric fields are intensively generated when resonances occur along the lengthwise directions of the metal film in the filter shown in FIG. 3.

The inventors of the present invention measured resonance electric fields generated on the resonator of the filter 51 by using an electromagnetic field simulator (Hewlett-Packard Co., No. HFSS) and obtained the following results, which will be shown in FIGS. 5 and 6.

In the resonance mode C, obviously, resonance electric fields intensified at portions indicated by broken lines E in FIG. 5, that is, at portions along the lengthwise sides 3*a* and 3*b* on both sides of the widthwise sides 3*c* and 3*d*.

On the other hand, it was seen that in the resonance mode D generated along the lengthwise sides, as shown by broken lines F in FIG. 6, resonance electric fields intensified near the widthwise sides 3*c* and 3*d* of the metal film 3.

After considering the resonance electric field distributions above, the inventors discovered that a dual mode band pass filter could be formed by adjusting the resonance electric fields generated in one of the two resonance modes C and D to make the resonance frequencies of the resonance modes C and D closer to each other.

Therefore, in the dual mode band pass filter 1 of the first preferred embodiment of the present invention, based on the above findings, at substantially central portions of the widthwise sides 3*c* and 3*d*, the portions 2*a* and 2*b* having the relatively high permittivities are provided. With this arrangement, the resonance frequency of the resonance mode along each of the lengthwise sides, that is, the resonance frequency of the resonance mode D shown in FIG. 4 is reduced, and the two resonance modes are thereby mutually coupled. In other words, the portions 2*a* and 2*b* having the relatively high permittivities are arranged such that the two resonance modes are mutually coupled.

Figure 7:
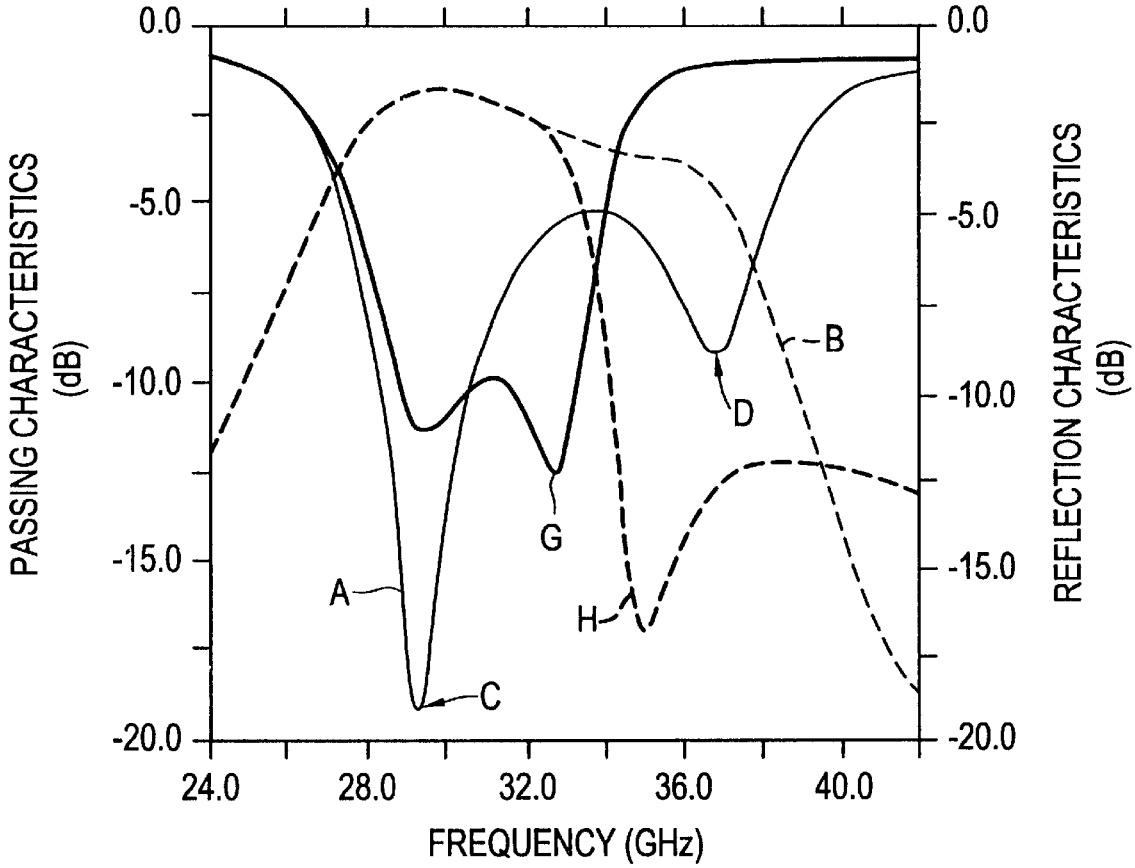
FIG. 7 shows a graph illustrating the frequency characteristics of the filter used in the first preferred embodiment and the filter prepared for comparison.

FIG. 7 shows the frequency characteristics of the dual mode band pass filter 1 of the first preferred embodiment of the present invention. In this graph, a solid line G indicates the reflection characteristics of the filter 1 and a broken line H indicates the passing characteristics of the filter 1. For comparison, the frequency characteristics of the filter 51 shown above are also indicated by a solid line A and a broken line B.

As shown in FIG. 7, in the dual mode band pass filter 1 of this preferred embodiment, two resonance modes are coupled to each other, by which the filter 1 functions as a dual mode band pass filter.

In the dual mode band pass filter 1 of the first preferred embodiment of the present invention, the difference between the relative permittivity of each of the portions 2*a* and 2*b* and the relative permittivity of the remaining portions, the planar shapes of the portions 2*a* and 2*b*, and the area dimensions of the planar shapes thereof are adjusted to facilitate adjustments of the frequency of the resonance mode propagating in each of the lengthwise directions. As a result, since two resonance modes can be coupled to each other without fail, band pass filter characteristics having a desired bandwidth can be easily obtained.

In the first preferred embodiment of the present invention, the portions 2*a* and 2*b* having relatively high permittivities are arranged in the approximately central portions of the widthwise sides. However, the portions having relative permittivities different from that of the remaining portion may be disposed at the lengthwise sides. In this case, this arrangement influences the frequency of a resonance mode propagating along each of the widthwise sides. Thus, as portions having relative permittivities different from that of the remaining portion, it is necessary to provide portions having relative permittivities that are lower than that of the remaining portion at the lengthwise sides.

Figure 8:
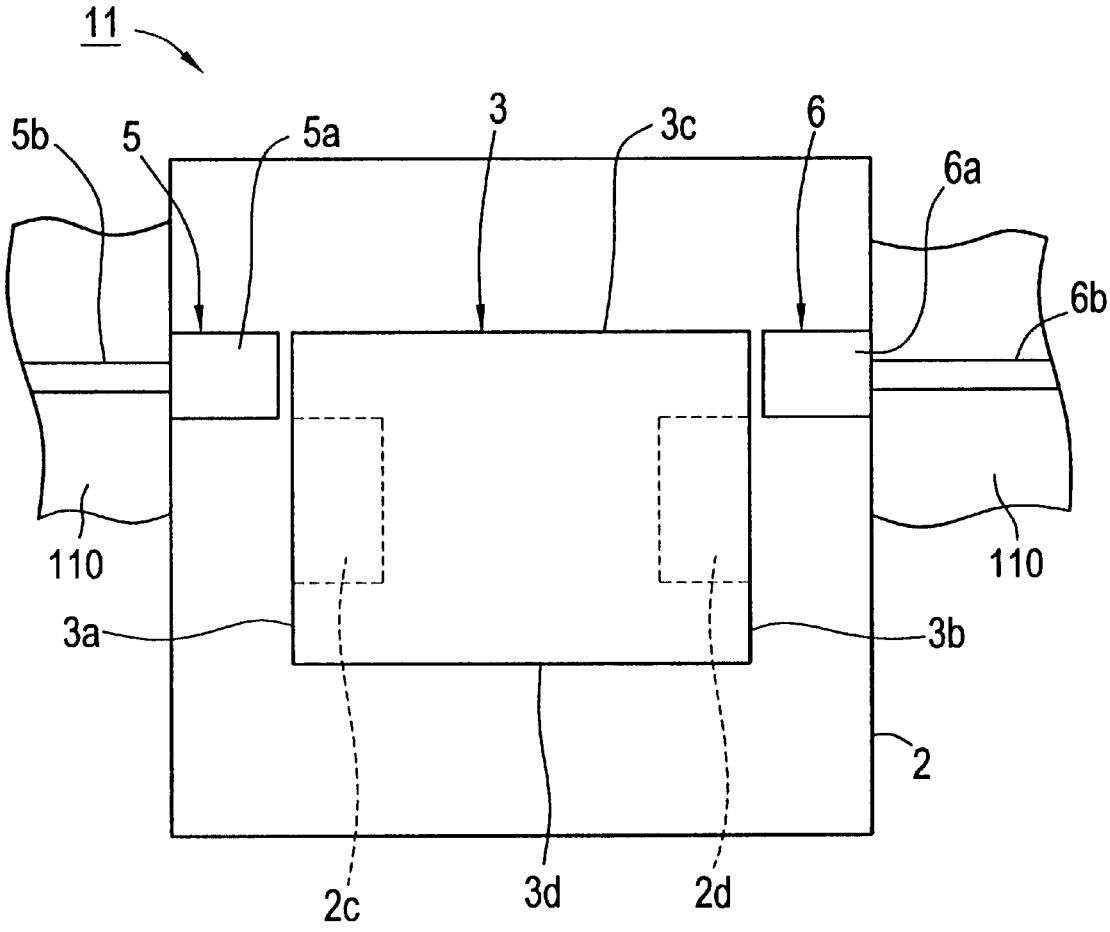
FIG. 8 shows a schematic plan view of a dual mode band pass filter according to a modified example of the first preferred embodiment of the present invention.

FIG. 8 shows a schematic plan view of a modified example of the band pass filter 1, in which portions having relatively low permittivities are disposed at lengthwise sides 3*a* and 3*b* of a metal film 3.

In a dual mode band pass filter 11 according to the modified example, under the metal film 3, cavities 2*c* and 2*d* are provided in a dielectric body 2. The cavities 2*c* and 2*d* are disposed substantially in the approximate center of each of the lengthwise sides 3*a* and 3*b* in such a manner that the cavities 2*c* and 2*d* are positioned along the lengthwise sides 3*a* and 3*b* in a region where the metal film 3 is opposed to a ground electrode. Each of the cavities 2*c* and 2*d* has a substantially rectangular planar shape, which is, for example, approximately 200 $\mu$m long and approximately 600 $\mu$m wide. In addition, the cavities 2*c* and 2*d* penetrate from a top surface of the dielectric body 2 to a bottom surface thereof. However, it is not always necessary to form the cavities 2*c* and 2*d* in such a penetrating manner.

The relative permittivity of each of the cavities 2*c* and 2*d* is substantially equivalent to a relative permittivity of air. That is, the relative permittivity $\in$r is equal to 1.

Figure 9:
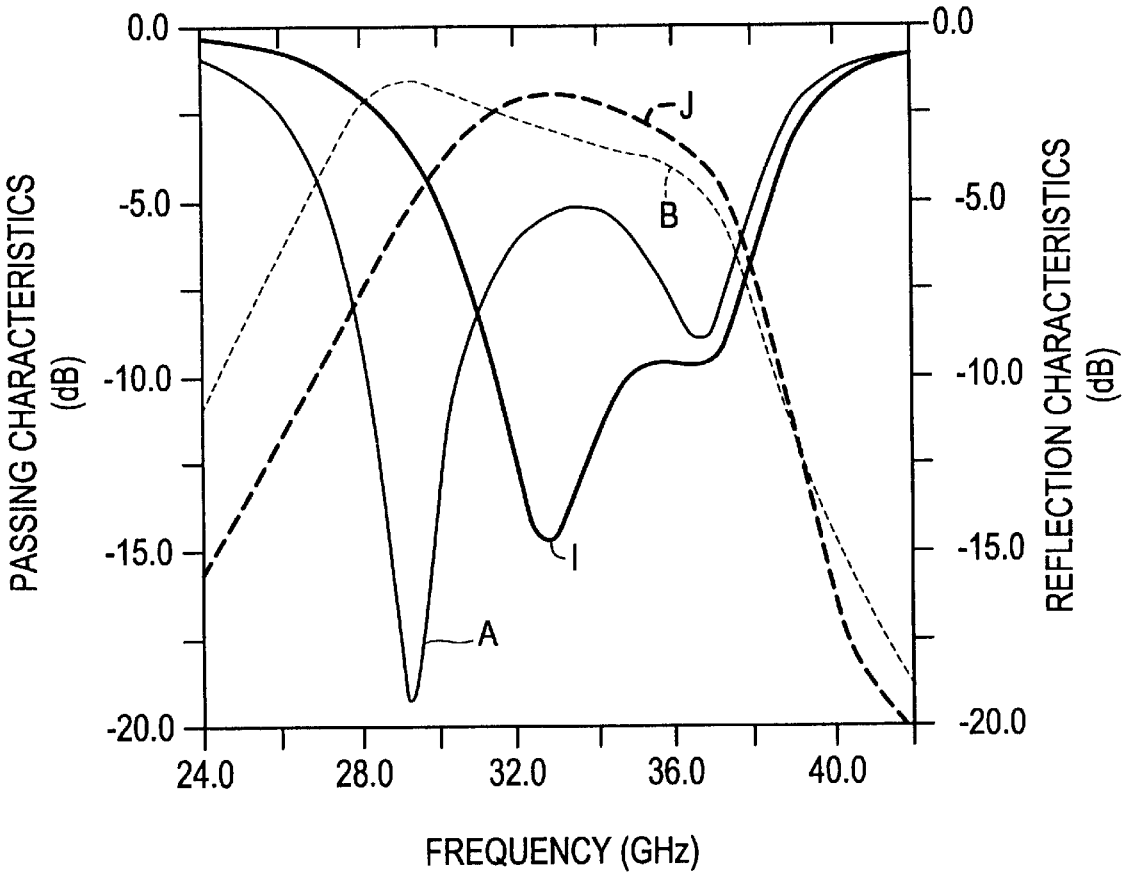
FIG. 9 shows a graph illustrating the frequency characteristics of the filter as the modified example shown in FIG. 8 and the filter shown in FIG. 3.

FIG. 9 shows the frequency characteristics of the dual mode band pass filter 11 according to the modified example. In FIG. 9, a solid line I indicates the reflection characteristics of the filter 11 and a broken line J indicates passing characteristics thereof. For comparison, the frequency characteristics of the filter 51 described above are also indicated by a solid line A and a broken line B.

As shown in FIG. 9, in the filter 11 according to the modified example, at the lengthwise sides of the metal film 3, the cavities 2*c* and 2*d* are disposed in the dielectric body 2. As a result, this arrangement influences the resonance electric field of a resonance mode propagating in each of the widthwise directions of the metal film 3. As a result, since the frequency of the resonance mode C becomes higher and the two resonance modes are thereby mutually coupled, the filter 11 functions as a dual mode band pass filter.

Figure 10:
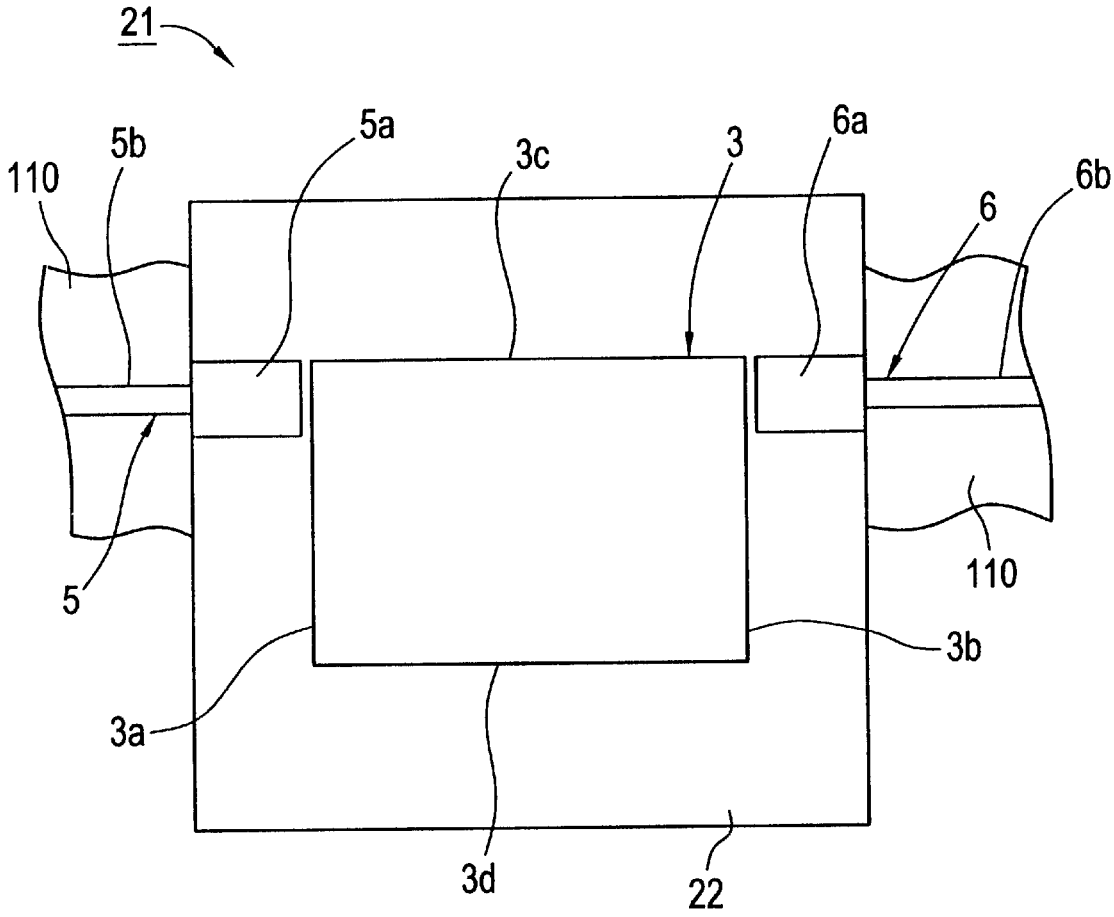
FIG. 10 shows a schematic plan view for illustrating the main portion of a dual mode band pass filter according to a second preferred embodiment of the invention.
Figure 11:
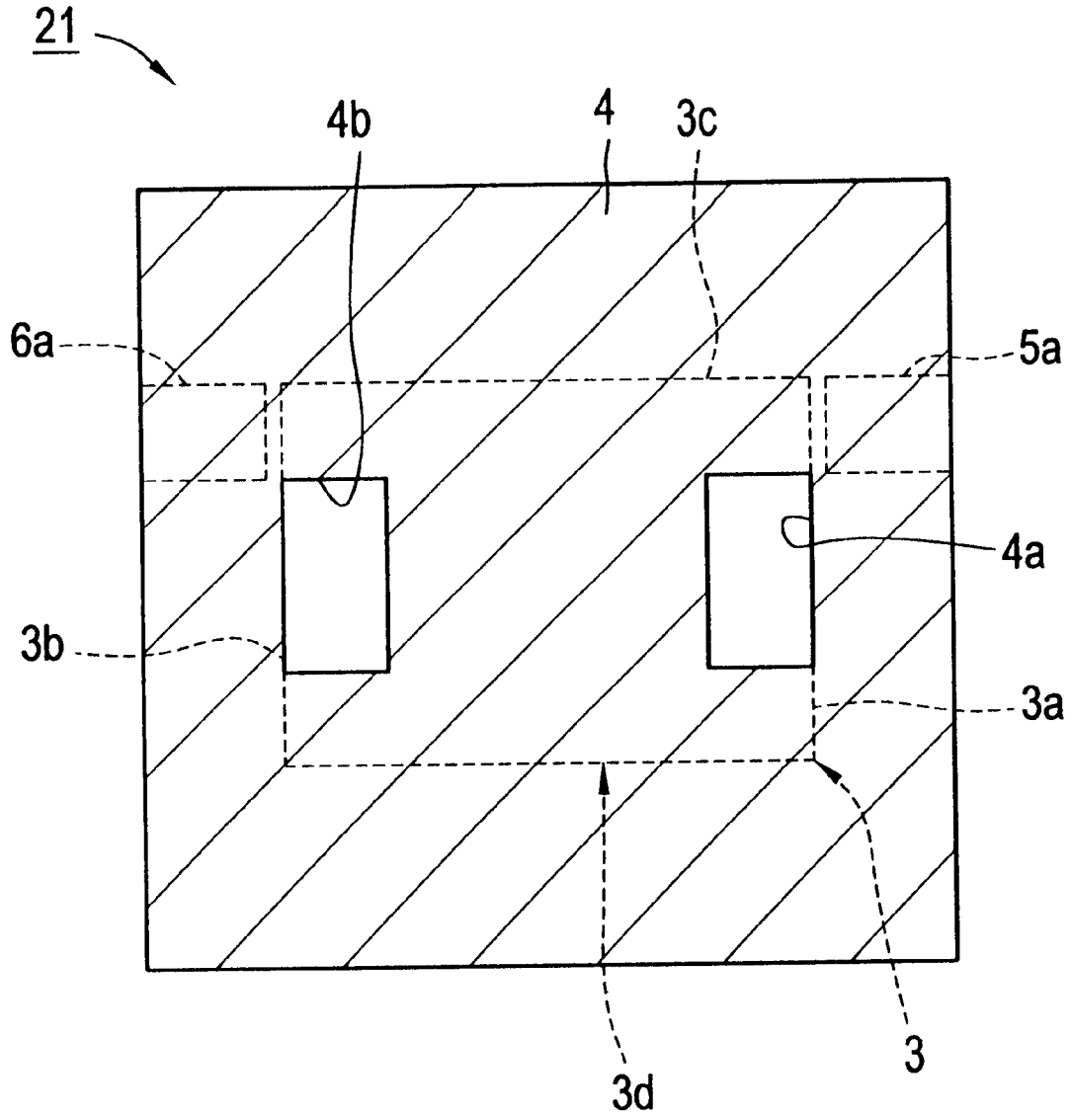
FIG. 11 shows a bottom surface view of the dual mode band pass filter according to the second preferred embodiment of the present invention.

FIG. 10 shows a schematic plan view of the main portion of a band pass filter according to a second preferred embodiment of the present invention. FIG. 11 shows a bottom surface view thereof. In a band pass filter 21 of the second preferred embodiment, a dielectric body 22 preferably has a thickness of about 300 $\mu$m, and is preferably made of an oxide Mg, Si, or Al having a relative permittivity $\in$r 7. On a top surface of the dielectric body 22, a metal film 3 and input/output coupling circuits 5 and 6 are arranged in the same way as those of the first preferred embodiment of the present invention. In addition, as shown in FIG. 11, a ground electrode 4 is disposed on a bottom surface of the dielectric body 22. In the second preferred embodiment, distinctively, openings 4*a* and 4*b* are provided in the ground electrode 4.

In other words, the openings 4*a* and 4*b* are arranged to couple two resonance modes in a region where the metal film 3 is opposed to the ground electrode 4. In this preferred embodiment, the openings 4*a* and 4*b* have substantially rectangular planar shapes in such a manner that the openings 4*a* and 4*b* are positioned along the lengthwise sides 3*a* and 3*b* of an image of the metal film 3 downwardly projected.

Thus, in the dual mode band pass filter 21, the openings 4*a* and 4*b* influence portions at which the resonance electric fields of resonance modes propagating in the widthwise sides of the metal film 3 are intensively generated. As a result, similar to the case of the modified example show in FIG. 8, the resonance frequency of the resonance mode C propagating in each of the widthwise directions of the metal film 3 becomes higher. Furthermore, the dimensions of the openings 4*a* and 4*b* are arranged such that the resonance modes C and D are mutually coupled. In this preferred embodiment, the widthwise sides of each of the openings 4*a* and 4*b* are about 0.8 mm long and the lengthwise sides of thereof are about 0.4 mm long.

Figure 12:
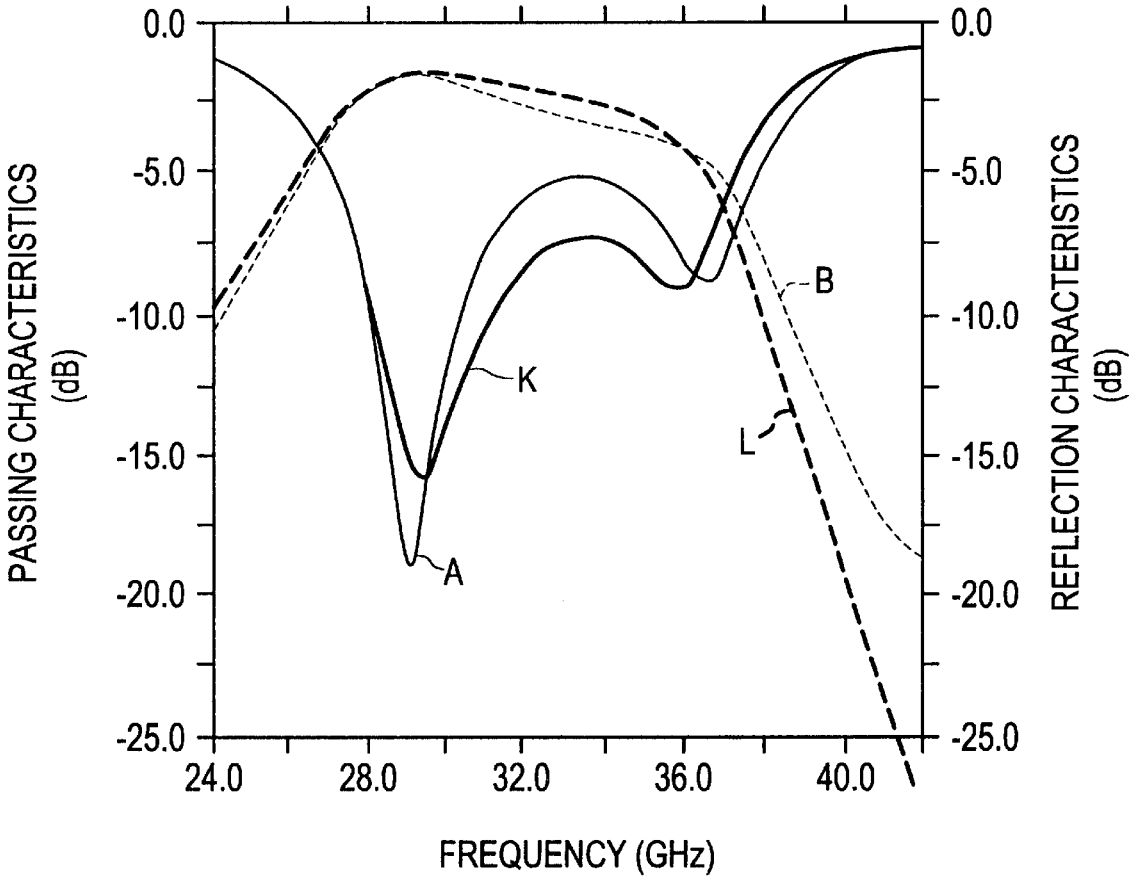
FIG. 12 shows a graph illustrating the frequency characteristics of the dual mode band pass filter according to the second preferred embodiment and the filter prepared for comparison.
Figure 13:
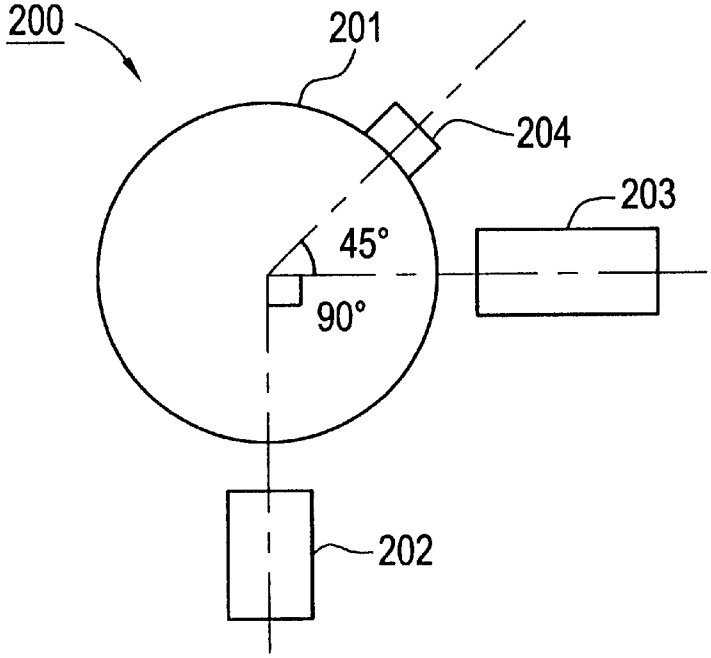
FIG. 13 PRIOR ART
FIG. 13 shows a schematic plan view of a conventional dual mode band pass filter.
Figure 14:
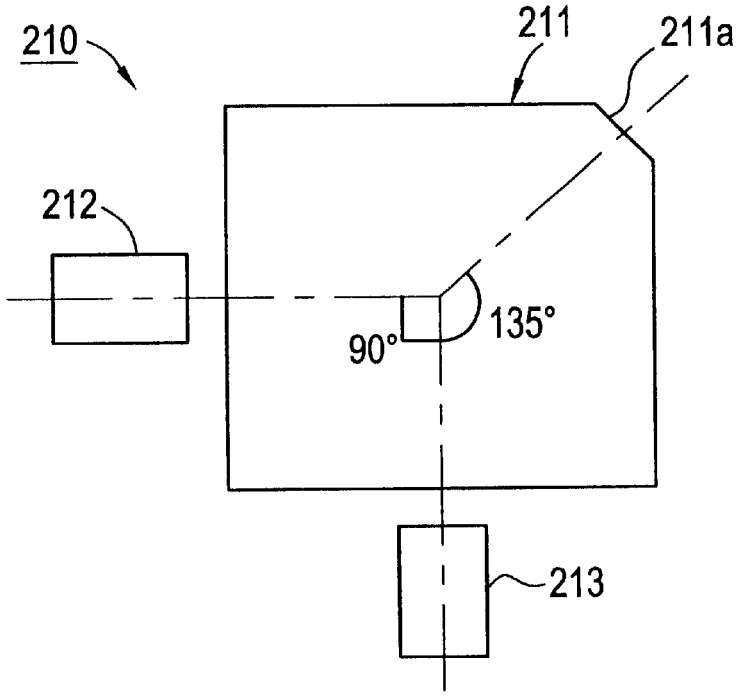
FIG. 14 PRIOR ART
FIG. 14 shows a schematic plan view of another conventional dual mode band pass filter.
Figure 15:
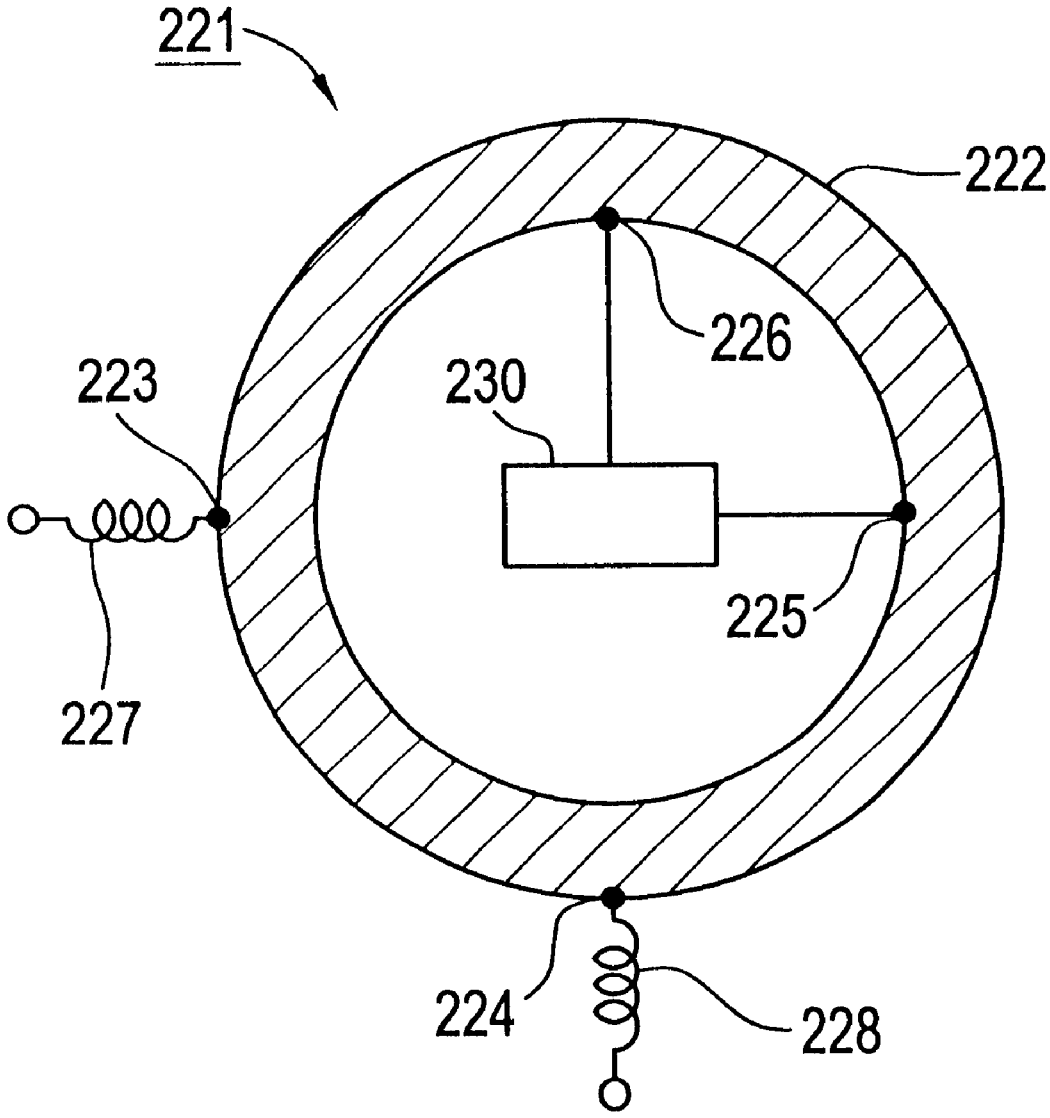
FIG. 15 PRIOR ART
FIG. 15 shows a schematic plan view of another conventional dual mode band pass filter.

A solid line K and a broken line L shown in FIG. 12 indicate the frequency characteristics of the dual mode band pass filter 21 of the second preferred embodiment. The solid line K indicates the reflection characteristics of the filter 21 and the broken line L indicates the passing characteristics thereof. For comparison, the frequency characteristics of the filter 51 described above are also shown in FIG. 12. As obvious in FIG. 12, in the second preferred embodiment, two resonance modes are coupled to each other by forming the openings 4*a* and 4*b*.

In each of the first preferred embodiment and the modified example, the portions having relative permittivities different from that of the remaining portion are provided on the dielectric body, and in the second preferred embodiment, the openings are disposed in the ground electrode in order to control the resonance electric fields. Alternatively, these methods may be used together. That is, both methods of the first preferred embodiment and the second preferred embodiment may be combined as shown in FIG. 17.

In addition, although the metal film 3 preferably has a substantially rectangular shape in each of the first and second preferred embodiments, the shape of the metal film 3 is not restricted to that and it can be arbitrary.

Nevertheless, in order to generate two resonance modes having different resonance frequencies, it is preferable to use a metal film having widthwise directions and lengthwise directions.

More specifically, the planar shape of the metal film may be various shapes including substantially rectangular, substantially rhombic, substantially polygonal, substantially circular, or substantially elliptical.

In addition, in each of the first and second preferred embodiments, although the metal film 3 is formed on the top surface of the dielectric body 2, the metal film 3 may be disposed at a certain height in the dielectric body. Similarly, as long as the ground electrode 4 is opposed to the metal film 3 via the dielectric body, it is not always necessary to provide the ground electrode 4 on the bottom surface of the dielectric body 2. The ground electrode 4 may be provided inside the dielectric body 2 as seen in FIG. 16.

Furthermore, a dual mode band pass filter having a triplate structure may be provided by disposing the metal film at the intermediate height position of the dielectric body 2 and disposing the ground electrode on a top surface and a bottom surface of the dielectric body 2.

As described above, in the dual mode band pass filter according to various preferred embodiments of the present invention, a metal film for forming a resonator is disposed on a dielectric body, and there are provided input/output coupling circuits coupled to the metal film so that two resonance modes are generated. In addition, in order to couple the two resonance modes, the relative permittivities of portions of the dielectric body are made different from a relative permittivity of the remaining portion of the dielectric body in a region where the metal film is opposed to the ground electrode via the dielectric body. As a result, the two resonance modes can be mutually coupled to obtain the characteristics of a dual mode band pass filter.

In the conventional dual mode band pass filter, the shape of the metal film defining the resonator and the positions of points for coupling the input/output coupling circuits to the metal film are restricted. In contrast, the dual mode band pass filter of preferred embodiments of the present invention does not have any such restrictions. Thus, a dual mode band pass filter can be more freely designed.

Moreover, wider adjustments of the bandwidth of the filter can be made by changing the dimensions of the metal film, the dimensions of the portions of the dielectric body having relative permittivities different from that of the remaining portion thereof, and the positions of the coupling points of the input/output coupling circuits.

When the portions having the different relative permittivities are provided by the cavities disposed in the dielectric body, by only forming the cavities in the dielectric body, the two resonance modes can be easily coupled to each other.

In the dual mode band pass filter according to the second preferred embodiment of the invention, a metal film for forming a resonator is disposed on the dielectric body. Since the metal film is coupled to the input/output coupling circuits, two resonance modes are generated. In order to couple the two resonance modes, portions of a ground electrode are cut away in a region where the metal film is opposed to the ground electrode. As a result, similar to the first preferred embodiment of the invention, since the two resonance modes are mutually coupled, the characteristics of a dual mode band pass filter can be obtained.

In the second preferred embodiment of the invention, there are no restrictions on the shape of the metal film defining the resonator and the positions of the coupling points of the input/output coupling circuits. Thus, the dual mode band pass filter can be more freely designed.

In addition, wider adjustments of the bandwidth can be made by changing the shapes of the openings or cut-away portions disposed in the ground electrode, the positions of the coupling points of the input/output coupling circuits, and the dimensions of the metal film.

Therefore, according to the first and second preferred embodiments of the present invention, the dual mode band pass filter having a desired bandwidth can be easily obtained.

In each of the first and second preferred embodiments of the present invention, when the metal film is disposed on a first main surface of the dielectric body and the ground electrode is disposed on a second main surface thereof, by disposing a conductive film on each of the main surfaces of the dielectric body, the dual mode band pass filter according to preferred embodiments of the present invention can be easily obtained.

When the metal film has a shape that includes widthwise and lengthwise dimensions, the two resonance modes having different resonance frequencies can be easily generated.

Since the planar shape of the metal film is not restricted to a specific one, a metal film having a variety of shapes can be used in each of the dual mode band pass filters of the first and second preferred embodiments of the present invention. For example, arbitrarily, the planar shape of the metal film may be substantially rectangular, substantially rhombic, substantially polygonal, substantially circular, or substantially elliptical.

While the present invention has been described with reference to preferred embodiments thereof, it will be understood by those skilled in the art that the foregoing and other changes in form and details can be made therein without departing from the spirit and scope of the invention.

What is claimed is:

1. A dual mode band pass filter comprising:

a dielectric body having a first main surface and a second main surface;

a metal film partially disposed on one of the first main surface and in the interior of the dielectric body;

a ground electrode disposed on one of the second main surface and the interior of the dielectric body in such a manner that the metal film is opposed to the ground electrode via a portion of the dielectric body; and a pair of input/output coupling circuits coupled to different portions of the metal film;

wherein, in the region where the metal film is opposed to the ground electrode via the portion of the dielectric body, some portions of the dielectric body have relative permittivities that are different from a relative permittivity of the remaining portion of the dielectric body so that two resonance modes generated at the metal film are mutually coupled at a certain resonance frequency.

2. A dual mode band pass filter according to claim 1, further comprising cavities provided in the dielectric body.

3. A dual mode band pass filter according to claim 1, wherein the metal film is disposed on the first main surface of the dielectric body and the ground electrode is disposed on the second main surface of the dielectric body.

4. A dual mode band pass filter according to claim 1, wherein a shape of the metal film has lengthwise and widthwise dimensions.

5. A dual mode band pass filter according to claim 1, wherein a planar shape of the metal film is one of substantially rectangular, substantially rhombic, substantially polygonal, substantially circular, and substantially elliptical.

6. A dual mode band pass filter according to claim 1, wherein some portions have a relative permittivity of about 17 and the remaining portion of the dielectric body has a relative permittivity of about 7.

7. A dual mode band pass filter according to claim 1, wherein the dielectric body is made of an oxide including one of Mg, Si, and Al.

8. A dual mode band pass filter according to claim 1, wherein an oxide is included in some portions of the dielectric body.

9. A dual mode band pass filter according to claim 1, wherein some portions of the dielectric body having relatively high permittivities are arranged in the approximately central portions of the widthwise sides of the metal film.

10. A dual mode band pass filter according to claim 1, wherein some portions of the dielectric body having relatively high permittivities are arranged at the lengthwise sides of the metal film.

11. A dual mode band pass filter comprising:

a dielectric body having a first main surface and a second main surface;

a metal film partially disposed on one of the first main surface and the interior of the dielectric body;

a ground electrode disposed on one of the second main surface and the interior of the dielectric body in such a manner that the metal film is opposed to the ground electrode via a portion of the dielectric body;

a pair of input/output coupling circuits coupled to different potions of the metal film; and wherein, in the metal film, a first resonance mode is generated so as to propagate in direction substantially parallel to a virtual line connecting the pair of input/output coupling circuits and a second resonance mode is generated to propagate in a direction perpendicular to the virtual line, and in the region where the metal film is opposed to the ground electrode, one of at least one opening and a least one cut-away portion is provided in the ground electrode so that the two resonance modes generated at the metal film are mutually coupled at a certain resonance frequency.

12. A dual mode band pass filter according to claim 11, wherein the metal film is disposed on the first main surface of the dielectric body and the ground electrode is disposed on the second main surface of the dielectric body.

13. A dual mode band pass filter according to claim 11, wherein a shape of the metal film has lengthwise and widthwise dimensions.

14. A dual mode band pass filter according to claim 11, wherein a planar shape of the metal film is one of substantially rectangular, substantially rhombic, substantially polygonal, substantially circular, and substantially elliptical.

15. A dual mode band pass filter according to claim 11, wherein some portions have a relative permittivity of about 17 and the remaining portion of the dielectric body has a relative permittivity of about 7.

16. A dual mode band pass filter according to claim 11, wherein the dielectric body is made of an oxide including one of Mg, Si, and Al.

17. A dual mode band pass filter according to claim 11, wherein an oxide is included in some portions of the dielectric body.

18. A dual mode band pass filter according to claim 11, wherein some portions of the dielectric body having relatively high permittivities are arranged in the approximately central portions of the widthwise sides of the metal film.

19. A dual mode band pass filter according to claim 11, wherein some portions of the dielectric body having relatively high permittivities are arranged at the lengthwise sides of the metal film.

* * * * *